US005423444A

United States Patent [19]

Druitt

[11] Patent Number: 5,423,444

[45] Date of Patent: Jun. 13, 1995

[54] LINERLESS CLOSURE FOR CARBONATED BEVERAGE CONTAINER

[75] Inventor: Rodney M. Druitt, George's Hall, Australia

[73] Assignees: MK Plastics Pty Ltd., George's Hall; Precision Valve Australia Pty Ltd., Ingleburn, both of Australia

[21] Appl. No.: 623,911

[22] PCT Filed: Jun. 15, 1989

[86] PCT No.: PCT/AU89/00256

§ 371 Date: Mar. 14, 1991

§ 102(e) Date: Mar. 14, 1991

[87] PCT Pub. No.: WO89/12584

PCT Pub. Date: Dec. 28, 1989

[30] Foreign Application Priority Data

Jun. 17, 1988 [AU] Australia ..... PI8846

[51] Int. Cl.[6] ..... B65D 53/00

[52] U.S. Cl. ..... 215/344; 215/343; 215/DIG. 1

[58] Field of Search ..... 215/252, 341, 343, 344, 215/DIG. 1

[56] References Cited

U.S. PATENT DOCUMENTS

| | | | |
|---|---|---|---|
| 3,038,624 | 6/1962 | Weickmann | 215/41 |
| 3,053,406 | 9/1962 | Wandell | 215/344 X |
| 3,055,526 | 9/1962 | Plunkett | 215/344 X |
| 3,067,900 | 12/1962 | Kessler | 215/56 |
| 3,141,586 | 7/1964 | Wetterek | 222/476 |
| 3,151,757 | 10/1964 | Martin | 215/41 |
| 3,200,981 | 8/1965 | Harding | 215/41 |
| 3,203,571 | 8/1965 | Plunkett | 215/344 |
| 3,224,617 | 12/1965 | Hohl et al. | 215/31 |

(List continued on next page.)

FOREIGN PATENT DOCUMENTS

| | | | |
|---|---|---|---|
| 923965 | 8/1965 | Australia . | |
| 44533 | 4/1970 | Australia . | |
| 1418283 | 3/1983 | Australia . | |
| 716415 | 8/1965 | Canada | 206/25 |
| 955887 | 10/1974 | Canada | 206/21 |
| 109631 | 5/1984 | European Pat. Off. . | |
| 0146011 | 11/1984 | European Pat. Off. . | |
| 136088 | 4/1985 | European Pat. Off. . | |
| 293901 | 12/1988 | European Pat. Off. . | |
| 1213812 | 10/1958 | France . | |
| 1270357 | 10/1960 | France . | |
| 1550358 | 11/1967 | France . | |
| 1107541 | 10/1959 | Germany . | |
| 1807328 | 11/1967 | Germany . | |
| 0607702 | 10/1978 | Germany . | |
| 3008838 | 10/1980 | Germany . | |
| 169850 | 4/1982 | Netherlands . | |
| 407786 | 2/1966 | Switzerland . | |
| 587755 | 3/1977 | Switzerland . | |
| 788148 | 12/1957 | United Kingdom . | |
| 935574 | 8/1963 | United Kingdom . | |
| 1024762 | 4/1966 | United Kingdom . | |
| 1229322 | 4/1971 | United Kingdom . | |
| 1499895 | 2/1978 | United Kingdom . | |
| 1602746 | 11/1983 | United Kingdom . | |
| 2120219 | 11/1983 | United Kingdom . | |
| 2131774 | 6/1984 | United Kingdom . | |
| 302888 | 6/1971 | U.S.S.R. . | |

*Primary Examiner*—Allan N. Shoap
*Assistant Examiner*—Vanessa Caretto

[57] ABSTRACT

A one piece plastic closure for a container having an externally screw threaded neck, the closure comprising a top portion and an internally threaded skirt. The closure has an annular sealing rib which projects downwardly from the underside of the top portion. The rib includes a first, substantially cylindrical, portion contiguous with the underside of the top portion and lying adjacent or abutting to the skirt and a second, frusto-conical, portion contiguous with the end of the first portion distal to the underside of the top portion and extending radially inwardly to terminate in a circular free edge, such that during threaded engagement of the cap with the neck, the second, frusto-conical, portion will be engaged by a free end of the neck and folded back against the first, substantially cylindrical portion of the rib to form a gas-tight seal between the neck of the container and the closure.

17 Claims, 4 Drawing Sheets

U.S. PATENT DOCUMENTS

| | | | |
|---|---|---|---|
| 3,255,907 | 6/1966 | Eddy | 215/40 |
| 3,286,866 | 11/1966 | McIntosh | 215/40 |
| 3,393,818 | 7/1968 | McIntosh | 215/56 |
| 3,405,830 | 10/1968 | Hayashida | 215/40 |
| 3,494,496 | 2/1970 | Livingstone | 215/40 |
| 3,568,871 | 5/1971 | Livingstone | 215/40 |
| 3,583,591 | 6/1971 | Hayashida | 315/40 |
| 3,632,005 | 1/1972 | Keasler | 215/41 |
| 3,784,041 | 1/1974 | Birch | 215/40 |
| 3,802,590 | 4/1974 | Culver | 215/40 |
| 3,814,274 | 6/1974 | McIntosh | 215/344 |
| 3,851,784 | 12/1974 | Gryncewicz | 215/40 |
| 3,854,618 | 12/1974 | Beghnini | 215/307 |
| 3,865,263 | 2/1975 | Birch | 215/321 |
| 3,948,405 | 4/1976 | Yonker | 215/344 |
| 3,986,627 | 10/1976 | Zapp | 215/237 |
| 3,990,598 | 11/1976 | Zapp et al. | 215/272 |
| 4,016,996 | 4/1977 | Aichinger et al. | 215/344 |
| 4,061,240 | 12/1977 | Brownsbill | 215/270 |
| 4,069,937 | 1/1978 | Smalley | 215/344 |
| 4,089,463 | 5/1978 | Babiol | 215/329 |
| 4,090,631 | 5/1978 | Grussen | 215/329 |
| 4,125,201 | 11/1978 | Birch | 215/330 |
| 4,177,906 | 12/1979 | Von Hagel | 215/252 |
| 4,196,818 | 4/1980 | Brownbill | 215/252 |
| 4,210,251 | 7/1980 | Grussen | 215/329 |
| 4,220,250 | 9/1980 | Brownbill | 215/270 |
| 4,253,581 | 3/1981 | Aichinger et al. | 215/344 |
| 4,276,989 | 7/1981 | Hicks | 215/344 |
| 4,301,937 | 11/1981 | Von Hagel | 215/252 |
| 4,325,487 | 4/1982 | Libit | 215/330 |
| 4,398,645 | 8/1983 | Toeppen | 215/252 |
| 4,416,383 | 11/1983 | Frahm et al. | 215/256 |
| 4,442,947 | 4/1984 | Banich, Sr. | 215/344 |
| 4,450,973 | 5/1984 | Toeppen | 215/329 |
| 4,461,392 | 7/1984 | Conti | 215/270 |
| 4,526,284 | 7/1985 | Herbert | 215/329 |
| 4,540,102 | 9/1985 | Wiedmer | 215/344 |
| 4,598,835 | 7/1985 | Brownbill | 215/307 |
| 4,623,070 | 11/1986 | Nishikawa | 215/329 |
| 4,708,255 | 11/1987 | Thompson | 215/329 |
| 4,726,484 | 2/1988 | Lutz | 215/329 |
| 4,739,893 | 4/1988 | Zumbuhl | 215/344 |
| 4,768,669 | 9/1988 | Kane et al. | 215/344 |
| 4,793,506 | 12/1988 | Thompson | 215/344 |
| 4,811,857 | 3/1989 | Thompson | 215/329 |
| 4,823,967 | 4/1989 | Thompson | 215/222 |
| 4,856,668 | 8/1989 | Pfefferkorn . | |
| 4,872,304 | 10/1989 | Thompson | 53/487 |
| 4,905,852 | 3/1990 | Zumbuhl | 215/270 |
| 4,907,709 | 3/1990 | Abe et al. | 215/252 |
| 4,917,269 | 4/1990 | Fuchs et al. | 222/109 |

LINERLESS CLOSURE FOR CARBONATED BEVERAGE CONTAINER

FIELD OF THE INVENTION

This invention relates to caps for sealing the opening of screw top containers. In particular, the invention provides a screw top cap which seals bottles of carbonated liquid such as softdrinks but is well adapted to seal other containers such as glass or PET containers with contents at above or below atmospheric pressure or having gaseous components or requiring a hermatic seal.

BACKGROUND OF THE INVENTION

Screw top caps have been used for some time to seal various containers. Although many screw tops include a separate sealing gasket within the cap, there is substantial advantage to be had in producing a one-piece cap which still effectively seal the container.

Such a one piece cap is shown in the British patent 788148 (3 Aug. 1956) which includes a continuous lip within the top portion of the cap positioned to engage against the annular end face of the opening and provide a seal between the lip and the free end edge of the container with the lip curling over at its free edge. However, this cap provides a seal only against the free end edge of the container.

Australian application 15456/76 (30 Jun. 1976) discloses an alternative one-piece cap in which a annular lip extends from the inside top of the cap and engages the inner bore of a container opening so as to curl the free end of the lip in against the bore or inside surface of the opening. However, with his cap, effective sealing requires that the inside bore of the opening be of accurate and consistent dimensions. Furthermore, if aerated or other gaseous liquid is to be contained, gas pressure will tend to distort the lip and cause a seal failure.

Australian patent application 14180/83 (5 May 1983) describes a cap with two internal sealing structures. One of the structures is an annular shaped outer portion shaped to accept the outer peripheral edge of the free end of the container relying upon the pressure generated during the closing of the cap to seal against this outer edge. Further provided is an inner cylindrical lip to engage the inner bore of the container opening.

SUMMARY OF THE PRESENT INVENTION

According to the present invention there is provided a closure for a container having an externally screw threaded neck, said closure being molded in one piece from a resilient plastic material and comprising a top and a depending skirt which has on its internal surface a complementary screw thread, characterised in that an annular sealing rib projects downwardly from the top, the rib includes a first substantially cylindrical portion contiguous with the top and lying adjacent to or abutting with the skirt and a second, frusto-conical, portion contiguous with the end of the first portion distal to the top and extending radially inwardly to terminate in a circular free edge, the internal diameter of the first portion being equal to or only slightly larger than the external diameter of the neck of the container to which the closure is no be attached such that, during threaded engagement of the cap with the neck, the second, frusto-conical, portion will be engaged by a free end of the neck and folded back against the first, substantially cylindrical portion of the rib and to form a gas-tight seal between the neck of the container and the closure.

Preferably the plastics material is high density polyethylene, low density polyethylene, or polypropylene. Where the container is to be used for gaseous liquids, the plastics material must have a very low porosity to the gas. Preferably the rib is shaped and sized so that, during the threaded engagement of the closure with the container, the free edge of the rib contacts an inner surface of the or the surface of structure contiguous with the top, before the closure is fully engaged and such that the rib in the region proximal the free edge is pinched between the free end of the neck of the container and the top of the closure, or the structure contiguous with the top of the closure, when the closure is fully engaged with the container.

Preferably the first substantially cylindrical and second frusto-conical portions of the lip join at an included angle of at least 90°. It is also preferred that the rib is of a thickness tapering from a maximum thickness proximal the top to a minimum thickness at its annular free edge.

It is also preferred that the first substantially cylindrical and second frusto-conical portions of the lip smoothly join with an internal radius of from 0.1 mm to 0.5 mm, most preferably 0.2 mm. It is further preferred that the cross-sectional thickness of the rib proximate the join between the first and second portions is from 0.4 m to 0.8 m, most preferably approximately 0.6 mm.

Where the closure is adapted to seal a container with an Alcoa step finish, the first substantially cylindrical portion of the sealing rib joins the top spaced radially inwardly from the skirt so as to define a space of annular cross-section between the rib and skirt. Where the container neck has a standard finish the rib is closely spaced from, or contiguous with, the skirt.

BRIEF DESCRIPTION OF THE DRAWINGS

An exemplary embodiment of the invention will now be described with reference to the drawings which show.

PREFERRED EMBODIMENTS

Figure 1:
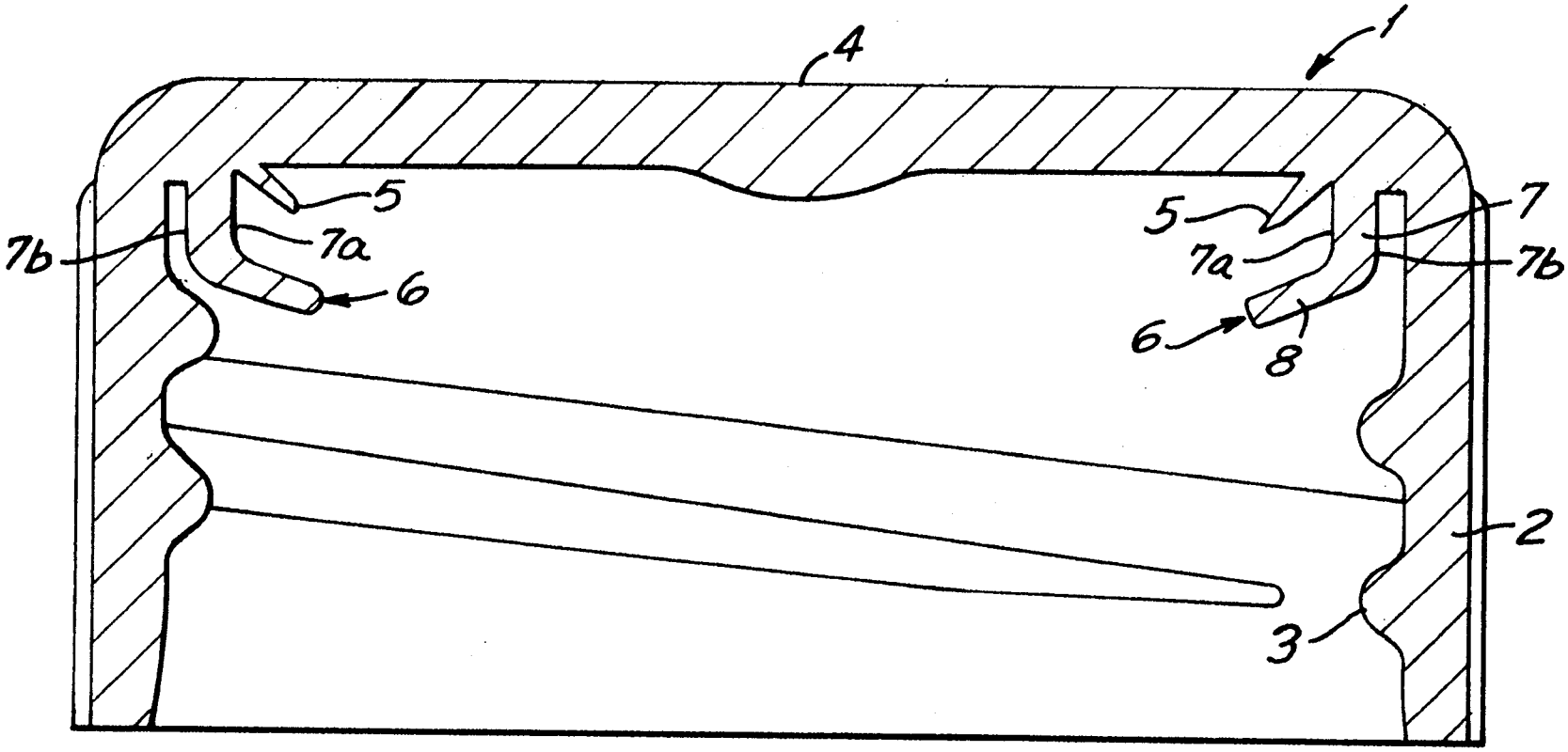
FIG. 1 an embodiment of the present invention in sectioned elevation.

FIG. 1 shows a cap 1 which is in many aspects a conventional screw top cap for a bottle to be used in containing a carbonated beverage. The cap 1 includes a continuous cylindrical sidewall 2 with a thread 3 formed on its interior surface. The top end of the cap 1 is closed by a top 4 which joins the skirt 2 in a continuous circular perimeter. The top 4 and skirt 2 being formed integrally from high density polyethylene by injection moulding.

The cap differs from known caps in that it includes an annular rib 6 which extends from the interior surface of the top 4 concentrically of the cap 1, being positioned close to the skirt 2. The annular sealing rib 6 includes a first or root portion 7 which extends from the top 4 approximately parallel to the skirt 2 with a second portion 8 extending from the end of the first portion 7 tapering inwardly and away from the end wall 8.

Figure 2:
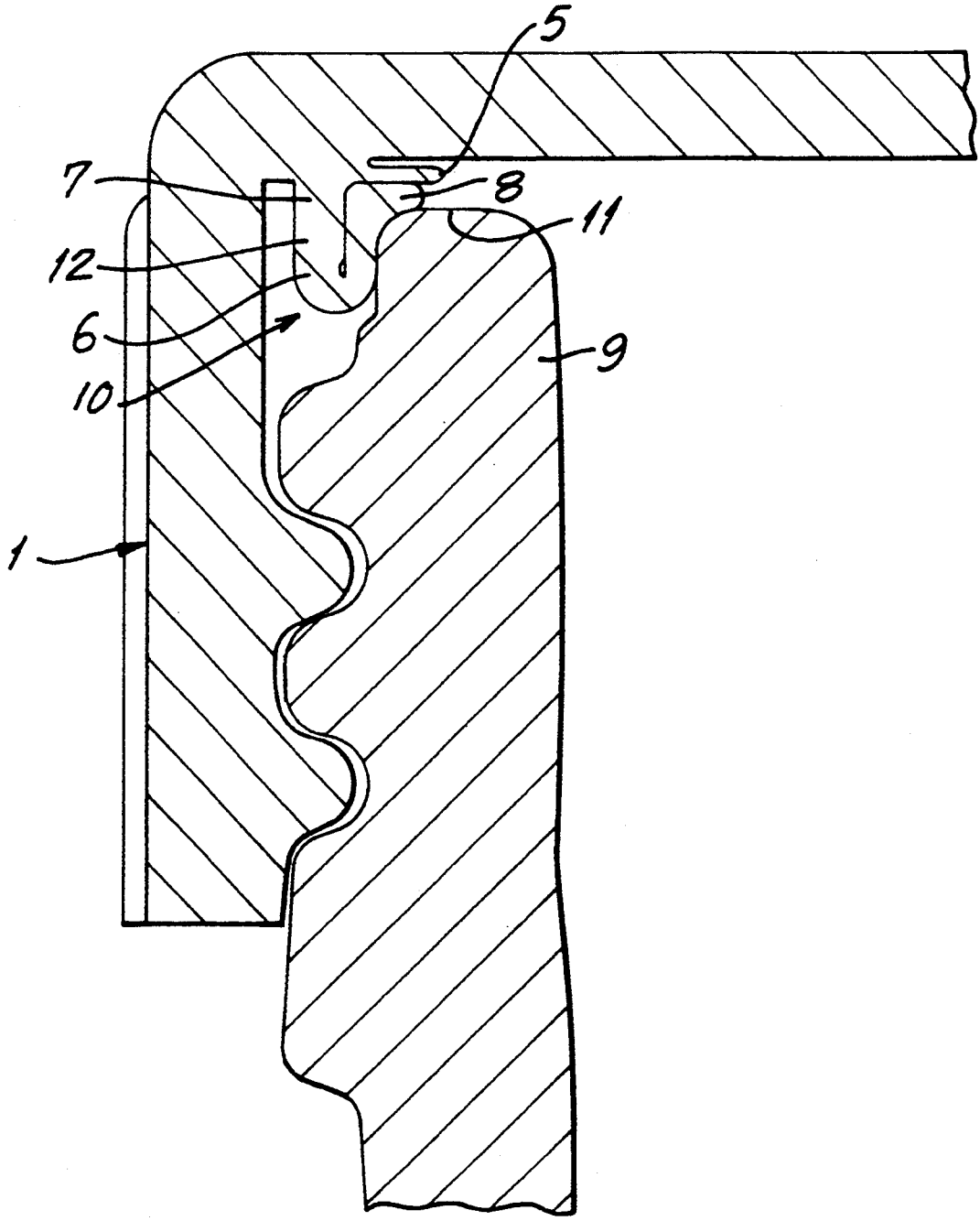
FIG. 2 he embodiment of FIG. 1 screwed onto a suitable container shown in sectional elevation.

The cap 1 can be seen in FIG. 2 screwed onto the screw top end 9 of a container not fully shown in the drawing. The end 9 of the container is finished with an "Alcoa step" 10 at the outer periphery of its open end extremity. The Alcoa step 10 allows a space between the end 9 of the container and the inner surface of the skirt 2 of the cap 1. The size of this annular space is sufficient to allow the second portion 8 of the outer rib 6 to contact the end 9 of the container as the cap 1 is being screwed onto the container, and for the second portion 8 to fold up on itself and against the root portion 7 and structure integral with the top 4. Thus there is formed a continuous gas tight seal between the cap 1 and the container extending from the Alcoa step 10 to the end surface of the container. There is no need of a separate seal inserted into the cap 1 prior to its application to the container as is common in the art.

As the cap 1 is attached in he above described manner, the second portion 8 of the sealing rib 6 is deformed by being bent towards the top 4. The deformation continues and contact is made between the second portion 8 of the sealing rib 6 and an inner rib 5 which effectively extends the structure of the top 4. The inner rib 5 in fact is not essential to the invention and can be dispensed with if the other components are suitably modified so that the end potion 8 contacts the top 4 during this deformation.

Once the second portion 8 has contacted the inner rib 5 (or top 4) further movement attaching the cap 1 will press and grip the contacting part of the second portion 8 between the container end 9 and he top 4. As the movement attaching the cap 1 continues, it tends to pinch the free edge of rib 6 between the container and the top 4 and to "pull" the first portion 7 of the outer rib tightly in towards the container end 9 to produce a tight seal about the curved edge surface of the container end 9 extending from its extreme end annular surface 11 to the Alcoa step region 10.

In the preferred embodiment shown in the drawings, an annular gap 12 is formed between the outer rib 6 and the skirt 7, proximate the top 4. This is one means of accommodating the Alcoa step 10 and allowing the necessary movement of the outer rib 6 during application of the cap 1 to a container end 9.

The dimensions of the outer rib 6, in conjunction with the design shape of the rib 6 and its material of construction, will clearly influence the effectiveness of the cap 1. Not only the sealing effectiveness but also the mouldability, removal torque, reusability and consistency are important. For the high density polyethelene cap shown in the drawings, the inner radius joining the first and second portions 7 and 8 of the outer rib 6 is 0.2 mm, the outer radius 0.5 mm and the cross-sectional thickness approximately 0.6 mm (slightly tapered for mould removal).

Figure 3:
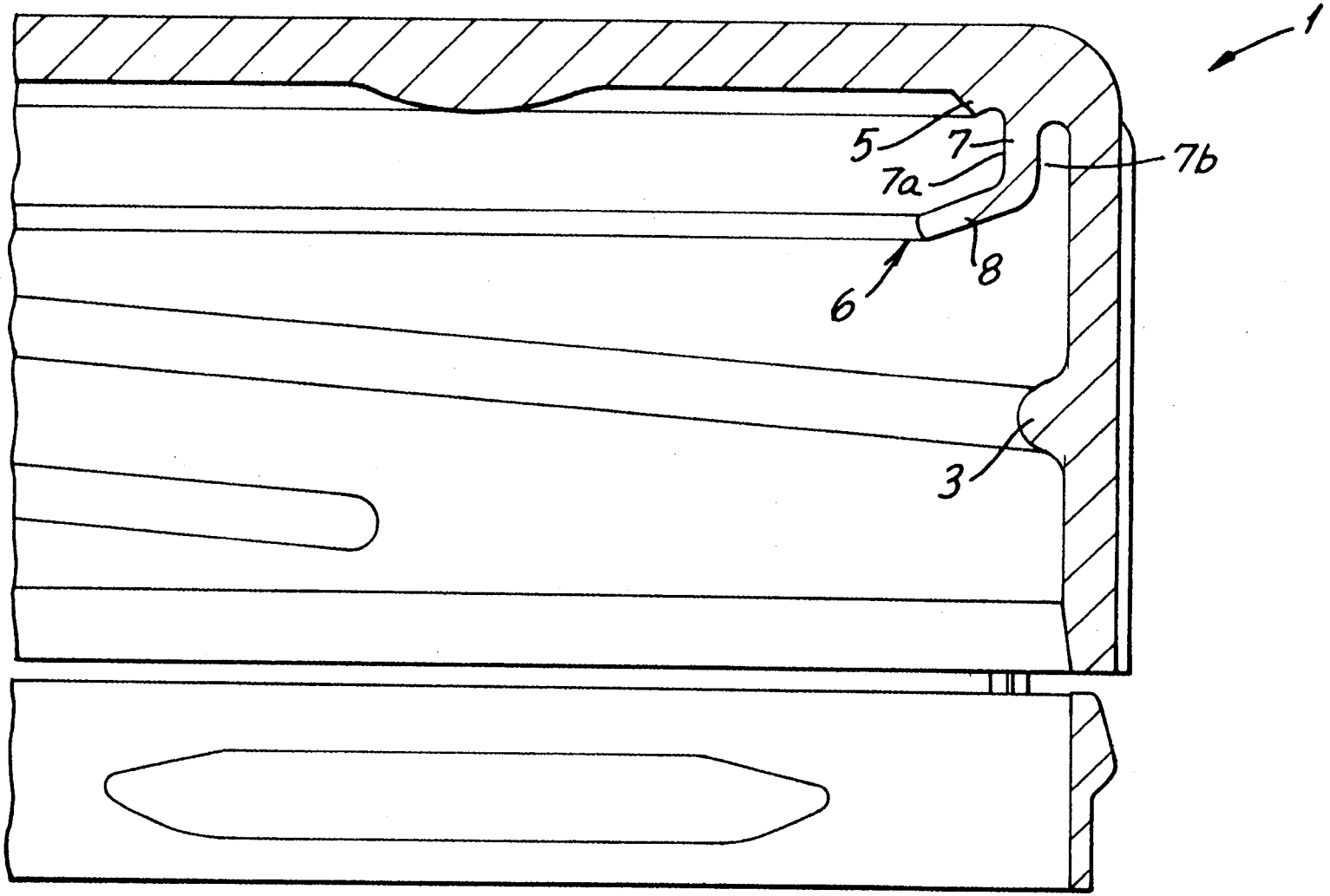
FIG. 3 an alternative embodiment in sectional elevation.

The alternative embodiment of FIG. 3 has a very much smaller inner rib 5 but is otherwise substantially %he same as the embodiment of FIG. 1 and 2.

Figure 4:
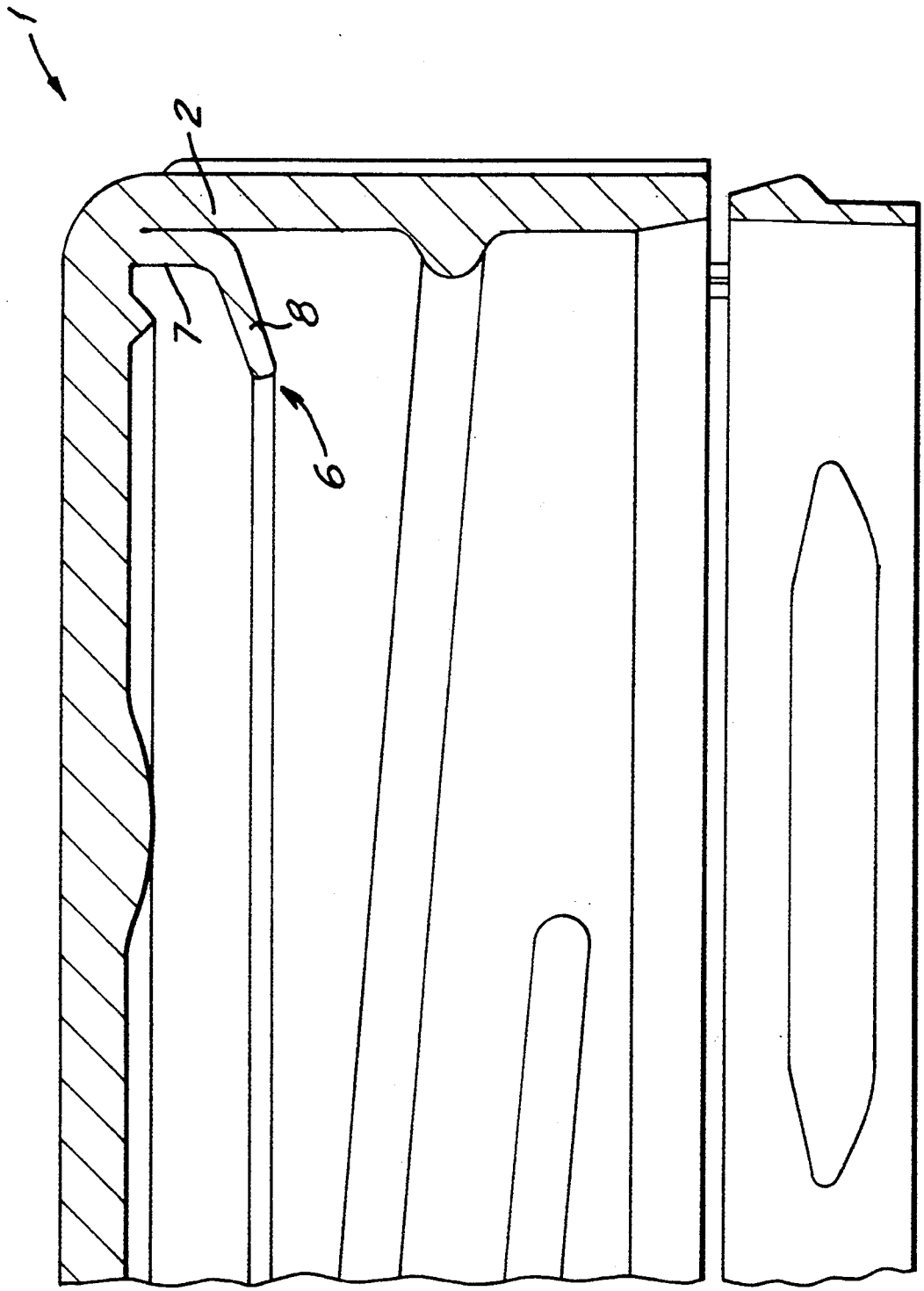
FIG. 4 is a second alternative embodiment in sectional elevation.

The alternative embodiment of FIG. 4 shows the first portion (7) of the rib (6) abutting the skirt (2).

The cap is modified (not illustrated) for containers not finished with an Alcoa step. Importantly, the inner diameter at the skirt and the thread dimensions must provide a secure engagement with the container thread. Further the inner dimension of the first portion 7 of the sealing rib 6 is preselected to be equal to, or slightly greater than, the external diameter of the container neck at the opening. Some radial flex should be provided in the sealing rib 6 so that on application of the cap to the container the second portion 8 can uniformly bend back onto the first portion 7.

I claim:

1. A closure for a container having an externally screw threaded neck, said closure being molded in one piece from a resilient plastic material and comprising a top portion and a skirt depending from an underside of the top portion, which skirt has an internal surface with a complimentary screw thread, characterized in that an annular sealing rib projects downwardly from the underside of the top portion, the rib includes a first portion having a substantially cylindrical inner surface, the first portion being contiguous with the top portion and lying adjacent to the skirt and a second, frusto-conical, portion contiguous with an end of the first portion distal to the top portion and extending radially inwardly to terminate in a circular free edge, the first portion having an internal diameter equal to or only slightly larger than an external diameter of the neck of the container to which the closure is to be attached such that during threaded engagement of the closure with the neck, the second, frusto-conical, portion will be engaged by a free end of the neck and folded back against the substantially cylindrical inner surface of the first portion of the rib to form a gas-tight seal between at least an outer surface of the neck of the container and the closure.

2. A closure as defined in claim 1 wherein during said threaded engagement interaction between the rib and the neck of the container will cause said rib, while folding back, to contact an inner surface portion of the top portion to provide a gas-tight seal with the container.

3. A closure as defined in claim 2 wherein said surface portion of the underside of the top portion is defined by part of a second continuous annular rib being contiguous with the underside of the top portion of the closure.

4. A closure as defined in claim 3 wherein the second rib extends radially inwardly and away from said top portion and is tapered in cross-section.

5. A closure as defined in claim 4, wherein upon attachment of said closure to said container, said second rib is deformed by being bent towards the underside of said top portion subsequent to contact with said sealing rib.

6. A closure as defined in claim 5 wherein said first portion joins said top portion at a position radially displaced from said skirt so as to define a generally annular gap between said first portion and the skirt.

7. A closure as defined in claim 2 wherein the rib has a shape, size and material of construction selected such that, during attachment of said closure to a container, said rib is frictionally engaged between said free end of the container neck and a surface portion of the underside of the top portion once mutual contact is made so that final movement of said closure draws a portion of the rib adjacent an outer top surface of the container tightly against said top surface so as to form a continuous seal from said top surface to a cylindrical side surface of the container neck.

8. A closure as defined in claim 7 wherein said surface portion is defined by part of a second continuous annular rib being contiguous with the underside of the top portion of the closure.

9. A closure as defined in claim 8 wherein said first portion joins said top portion at a position radially displaced from said skirt so as to define a generally annular gap between said first portion and the skirt.

10. A closure as defined in claim 1 wherein the rib has a shape, size and material of construction selected such that, during attachment of said closure to a container, said rib is frictionally engaged between said free end of the container neck and a surface portion of the underside of the top portion, once mutual contact is made so that final movement of said closure draws a portion of the rib adjacent an outer top surface of the container tightly against said top surface of the container so as to form a continuous seal from said top surface to a cylindrical side surface of the container neck.

11. A closure as defined in claim 10 wherein said surface portion is defined by part of a second continuous annular rib being contiguous with the underside of the top portion of the closure.

12. A closure as defined in claim 1 wherein said rib is tapered in cross-section so as to allow ejection of the closure from an injection mold.

13. A closure as defined in claim 1, wherein the first portion is abutting the skirt.

14. A closure as defined in claim 1 wherein during said threaded engagement interaction between the rib and the neck of the container will cause the rib, while folding back, to contact an inner surface portion of structure contiguous with the top portion to provide a gas-tight seal with the container.

15. A container package comprising a container having an externally screw threaded neck, a closure molded in one-piece from a resilient plastic material and comprising a top portion and a skirt depending from an underside of the top portion which skirt has on an internal surface a complementary screw thread, the screw thread on the closure engaging the screw threaded neck such that the closure is attached to and closes the container, the closure further comprising an annular sealing rib projecting downwardly from an underside of the top portion, the rib including a first portion having a substantially cylindrical annular inner surface, the first portion being contiguous with an underside of the top portion and lying adjacent to the skirt, the first portion having an internal diameter at least equal to an external diameter of the neck of the container to which the closure is attached, and a second, frusto-conical, portion contiguous with an end of the first portion, distal to the an underside of the top portion, the second, frusto-conical, portion being engaged by a free end of the neck and folded back against the substantially cylindrical annular inner surface of the first portion of the rib forming a gas-tight seal between at least an outer surface of the neck of the container and the closure.

16. A container as defined in claim 15, wherein the first portion is abutting the skirt.

17. A closure for a container having an externally screw threaded neck, said closure being molded in one piece from a resilient plastic material and comprising a top portion and a skirt depending from an underside of the top portion, which skirt has an internal surface with a complimentary screw thread, characterized in that an annular sealing rib projects downwardly from the underside of the top portion and is disposed sufficiently proximate to the skirt such that during threaded engagement of the closure with the neck of the container, the neck of the container engages an end of the sealing rib distal to an underside of the top portion, the rib includes a first portion having a substantially cylindrical inner surface, the first portion being contiguous with the top portion and a second, frusto-conical, portion contiguous with an end of the first portion distal to the top portion and extending radially inwardly to terminate in a circular free edge, the first portion having an internal diameter at least equal to an external diameter of the neck of the container to which the closure is to be attached such that during threaded engagement of the closure with the neck, the second, frusto-conical, portion will be engaged by a free end of the neck and folded back against the inner surface of the first, portion of the rib to form a gas-tight seal between at least an outer surface of the neck of the container and the closure.

* * * * *